US012644234B2

(12) United States Patent
Oetken

(10) Patent No.: US 12,644,234 B2
(45) Date of Patent: Jun. 2, 2026

(54) MONITORING COMPACTION ENERGY INTO A PAVING MATERIAL MAT

(71) Applicant: Caterpillar Paving Products Inc., Brooklyn Park, MN (US)

(72) Inventor: Nicholas A. Oetken, Brooklyn Park, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 239 days.

(21) Appl. No.: 18/343,321

(22) Filed: Jun. 28, 2023

(65) Prior Publication Data

US 2025/0003158 A1 Jan. 2, 2025

(51) Int. Cl.
*E01C 19/28* (2006.01)

(52) U.S. Cl.
CPC ..... *E01C 19/288* (2013.01); *E01C 19/282* (2013.01)

(58) Field of Classification Search
CPC ..... E01C 19/288; E01C 19/282; E01C 19/004
See application file for complete search history.

(56) References Cited

U.S. PATENT DOCUMENTS

| | | | | |
|---|---|---|---|---|
| 6,122,601 | A | 9/2000 | Swanson et al. | |
| 7,110,884 | B2 | 9/2006 | Tritico et al. | |
| 7,591,608 | B2 | 9/2009 | Hall et al. | |
| 8,190,338 | B2 | 5/2012 | Commuri | |
| 8,635,903 | B2 | 1/2014 | Oetken et al. | |
| 10,018,611 | B2 * | 7/2018 | Stromsoe | G01B 21/18 |
| 2008/0004809 | A1 | 1/2008 | Tritico et al. | |
| 2014/0255095 | A1 | 9/2014 | Tritico | |
| 2016/0076205 | A1 * | 3/2016 | Corcoran | E02D 3/026 73/784 |
| 2019/0186094 | A1 * | 6/2019 | Marsolek | E02D 3/046 |
| 2021/0172128 | A1 | 6/2021 | Marx | |

* cited by examiner

*Primary Examiner* — Anshul Sood
*Assistant Examiner* — Joshua Jeffrey Penko

(57) ABSTRACT

A controller may obtain compaction data indicating one or more of a vibration amplitude or a vibration frequency used for a compaction drum of the compactor machine at a plurality of locations of the compactor machine on a paving material mat. The controller may determine, based at least in part on the compaction data, compaction energies produced by the compactor machine at the plurality of locations on the paving material mat. The controller may cause the compactor machine to perform a compacting operation at an area of the paving material mat based on the compaction energies.

19 Claims, 3 Drawing Sheets

MONITORING COMPACTION ENERGY INTO A PAVING MATERIAL MAT

TECHNICAL FIELD

The present disclosure relates generally to compactor machines and, for example, to monitoring compaction energy into a paving material mat.

BACKGROUND

Compaction of a surface material, such as soil or asphalt, can improve strength and stability of the surface. In a paving context, a paving machine distributes hot paving material, such as asphalt, over a surface, and a mobile compactor machine follows the paving machine to compact the material to a desired density and obtain an acceptable surface finish. Commonly, the compactor machine may include one or more compaction drums that serve to propel the compactor machine and compact the paving material via the weight of the compactor machine.

The density of the compacted paving material may depend on various parameters used by the compactor machine during compaction, such as a travel speed, a drum vibration amplitude, and/or a drum vibration frequency. Because these parameters may not be constant over the course of a compacting operation, density variations of the compacted paving material may develop. In general, detecting the density of paving material being compacted is technically difficult, thereby making it difficult to ensure that uniform density of the paving material is produced over a compacted area. As a result of non-uniform density, the compacted area may need to be repaired or re-paved.

U.S. Pat. No. 6,122,601 (the '601 patent) discloses a system to obtain uniform density of compacted materials and track the compaction of the materials. The '601 patent discloses a density meter mounted on vibratory asphalt compaction equipment that estimates the density of an asphalt pavement during the compaction of the asphalt. The '601 patent indicates that the meter takes into account the vibratory response of the compaction equipment, which correlates to the density of the asphalt being compacted.

However, using the vibratory response of compaction equipment to estimate the density of paving material is error prone and may produce inaccurate density measurements. For example, using the vibratory response to estimate density may be based on accurately detecting small variations in vibrations of the compaction equipment. Accordingly, a highly sensitive sensor, that is costly and adds complexity to the compactor machine, may be needed. Moreover, compacting operations that are performed based on inaccurate density measurements may be inefficient, duplicative, or wasteful.

The controller of the present disclosure solves one or more of the problems set forth above and/or other problems in the art.

SUMMARY

A compactor machine may include a compaction member and a controller. The controller may be configured to obtain compaction data indicating one or more of a vibration amplitude or a vibration frequency used for the compaction member at a location of the compactor machine on a paving material mat. The controller may be configured to determine, based at least in part on the compaction data, a compaction energy produced by the compactor machine at the location of the compactor machine on the paving material mat. The controller may be configured to generate, based on the compaction energy, a compaction map indicating a degree of compaction at least at the location of the compactor machine on the paving material mat.

A controller of a compactor machine may include one or more memories and one or more processors coupled to the one or more memories. The one or more processors may be configured to obtain location data indicating a location of the compactor machine on a paving material mat. The one or more processors may be configured to obtain compaction data indicating one or more of a vibration amplitude or a vibration frequency used for a compaction drum of the compactor machine at the location of the compactor machine on the paving material mat. The one or more processors may be configured to determine, based at least in part on the compaction data, a compaction energy produced by the compactor machine at the location of the compactor machine on the paving material mat. The one or more processors may be configured to perform one or more actions based on compaction energies produced by the compactor machine at a plurality of locations of the paving material mat, where the compaction energies produced by the compactor machine at the plurality of locations include the compaction energy produced by the compactor machine at the location of the compactor machine on the paving material mat.

A method may include obtaining, by a controller of a compactor machine, compaction data indicating one or more of a vibration amplitude or a vibration frequency used for a compaction drum of the compactor machine at a plurality of locations of the compactor machine on a paving material mat. The method may include determining, by the controller and based at least in part on the compaction data, compaction energies produced by the compactor machine at the plurality of locations on the paving material mat. The method may include causing, by the controller, the compactor machine to perform a compacting operation at an area of the paving material mat based on the compaction energies.

DETAILED DESCRIPTION

This disclosure relates to a controller, which is applicable to any machine that performs compaction of a ground surface. For example, the machine may be a vibratory drum compactor machine, a soil compactor, a pneumatic roller, or another type of compactor machine.

Figure 1:
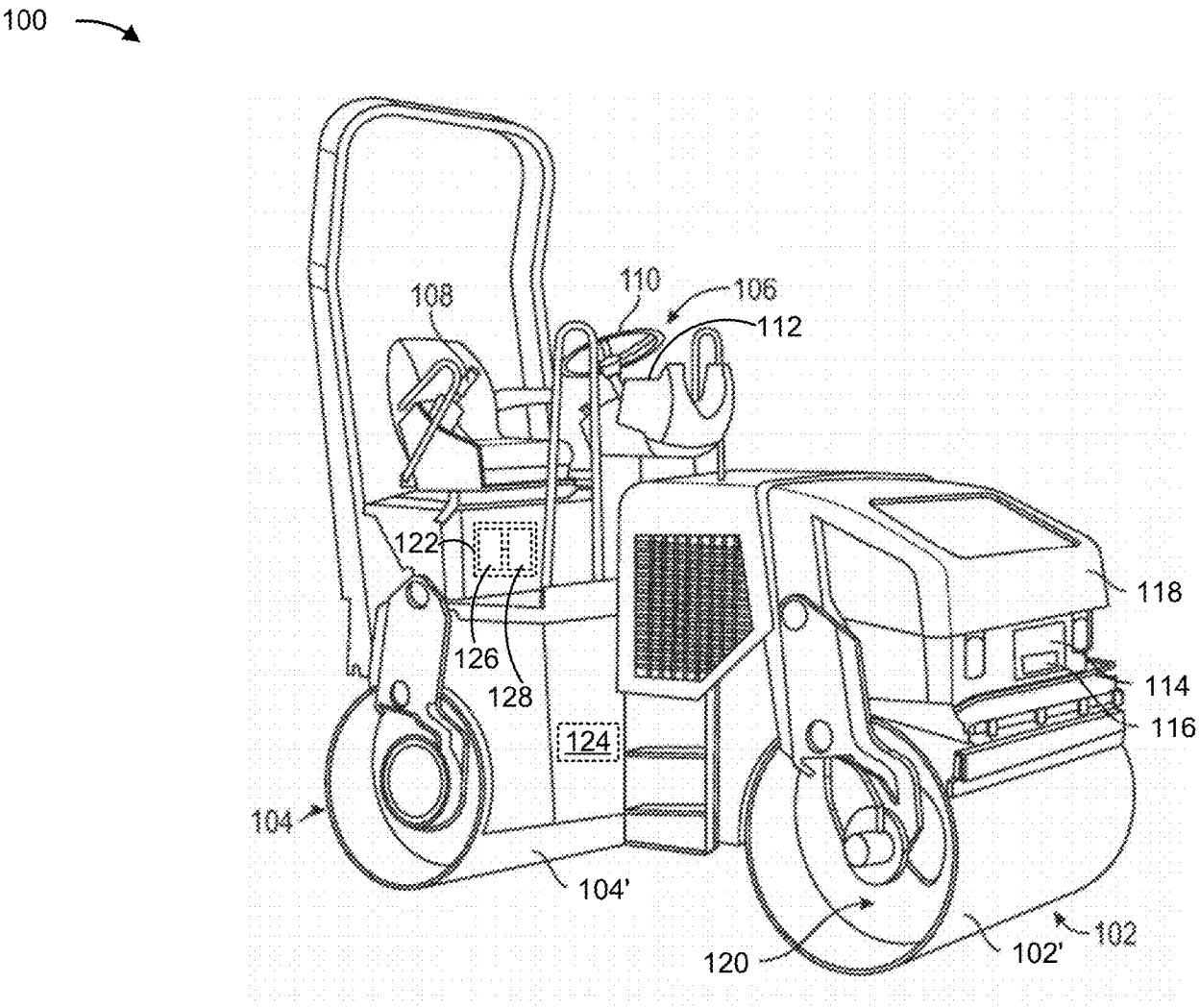
FIG. 1 is a perspective view of an example machine.

FIG. 1 is a perspective view of an example machine 100. While in FIG. 1 the machine 100 is depicted as a compactor machine, the machine 100 may be another type of machine, such as a cold planer, a soil compactor, a dozer, a motor grader, a paving machine, a pneumatic roller, or the like. The machine 100 may be an asphalt compactor machine (e.g., a self-propelled, double-drum compactor machine), a vibratory drum compactor machine, or the like, which may be used to compact various materials, such as soil and/or asphalt, among other examples.

The machine 100 has at least one compaction member, such as a compaction drum or a pneumatic tire. For example, as shown, the machine 100 has a front compaction drum 102 and a back compaction drum 104. The compaction drums 102, 104 are a set of ground-engaging members that provide ground engagement of the machine 100 at surfaces 102', 104' of the compaction drums 102, 104, respectively. The surfaces 102', 104' may include cylindrical surfaces that form exteriors of shells of the compaction drums 102, 104, respectively. As the machine 100 passes over a mat of paving material, the surfaces 102', 104' roll against the paving material and provide compaction forces to the paving material due to a weight of the machine 100. One or more of the compaction drums 102, 104 may include a vibratory component configured to cause the compaction drums 102, 104 to vibrate, thereby further facilitating compaction. In some examples, the machine 100 may include one or more other ground-engaging members, such as one or more wheels and/or one or more tracks, in addition or alternatively to the front compaction drum 102 or the back compaction drum 104.

The machine 100 includes an operator station 106 equipped with various systems and/or mechanisms for control of the operation of the machine 100. For example, the operator station 106 may include a drive system control 108 (shown as a shift lever) and/or a steering system control 110 (shown as a steering wheel). A steering system of the machine 100 may include the steering system control 110, a steering column (e.g., connected to the steering system control 110), a steering actuator (e.g., a steering cylinder for power steering), and/or a steering linkage assembly (e.g., that connects the steering system control 110 or the steering column to ground engagement members, such as the compaction drums 102, 104, via a plurality of linkage members, such as rods). The operator station 106 may also include a display 112 that provides a graphical user interface for operating the machine 100.

The machine 100 includes an engine 114 and a generator 116 coupled with the engine 114. The engine 114 and the generator 116 are attached to a frame 118 of the machine 100. The generator 116 may serve as an electrical power source for various onboard systems and components of the machine 100. The engine 114 may include any type of engine (e.g., an internal combustion engine, a gasoline engine, a diesel engine, a gaseous fuel engine, or the like). The engine 114 is configured to drive movement of the machine 100 (e.g., via compaction drums 102, 104) and other components of the machine 100, such as the generator 116. In some examples, the machine 100 may include an electric motor additionally or alternatively to the engine 114. A device for storing electrical power that can be supplied to the electric motor, as well as various onboard systems and components of the machine 100, such as a battery (not shown), may be provided. The machine 100 also includes a braking system 120 configured to receive operator input to decrease or arrest a speed of the machine 100.

The machine 100 includes a controller 122 for electrically controlling various aspects of the machine 100. For example, the controller 122 may send and receive signals from various components of the machine 100 during the operation of the machine 100. The controller 122 may include one or more memories 126 and one or more processors 128 communicatively coupled to the one or more memories 126. A processor 128 may include a central processing unit, a graphics processing unit, a microprocessor, a controller, a microcontroller, a digital signal processor, a field-programmable gate array, an application-specific integrated circuit, and/or another type of processing component. The processor 128 may be implemented in hardware, firmware, or a combination of hardware and software. The processor 128 may be capable of being programmed to perform one or more operations or processes described elsewhere herein. A memory 126 may include volatile and/or nonvolatile memory. For example, the memory 126 may include random access memory (RAM), read only memory (ROM), a hard disk drive, and/or another type of memory (e.g., a flash memory, a magnetic memory, and/or an optical memory). The memory 126 may be a non-transitory computer-readable medium. The memory 126 may store information, one or more instructions, and/or software (e.g., one or more software applications) related to the operation of the controller 122. The controller 122 may be configured to perform one or more operations described herein.

The machine 100 may also include one or more sensors 124. The sensors 124 may be configured to sense characteristics of the machine 100 and/or of an environment of the machine 100, and configured to provide signals to the controller 122 indicative of the sensed characteristics. A control system of the machine 100, for compaction monitoring, may include the controller 122 and/or the sensors 124.

As indicated above, FIG. 1 is provided as an example. Other examples may differ from what is described in connection with FIG. 1.

Figure 2:
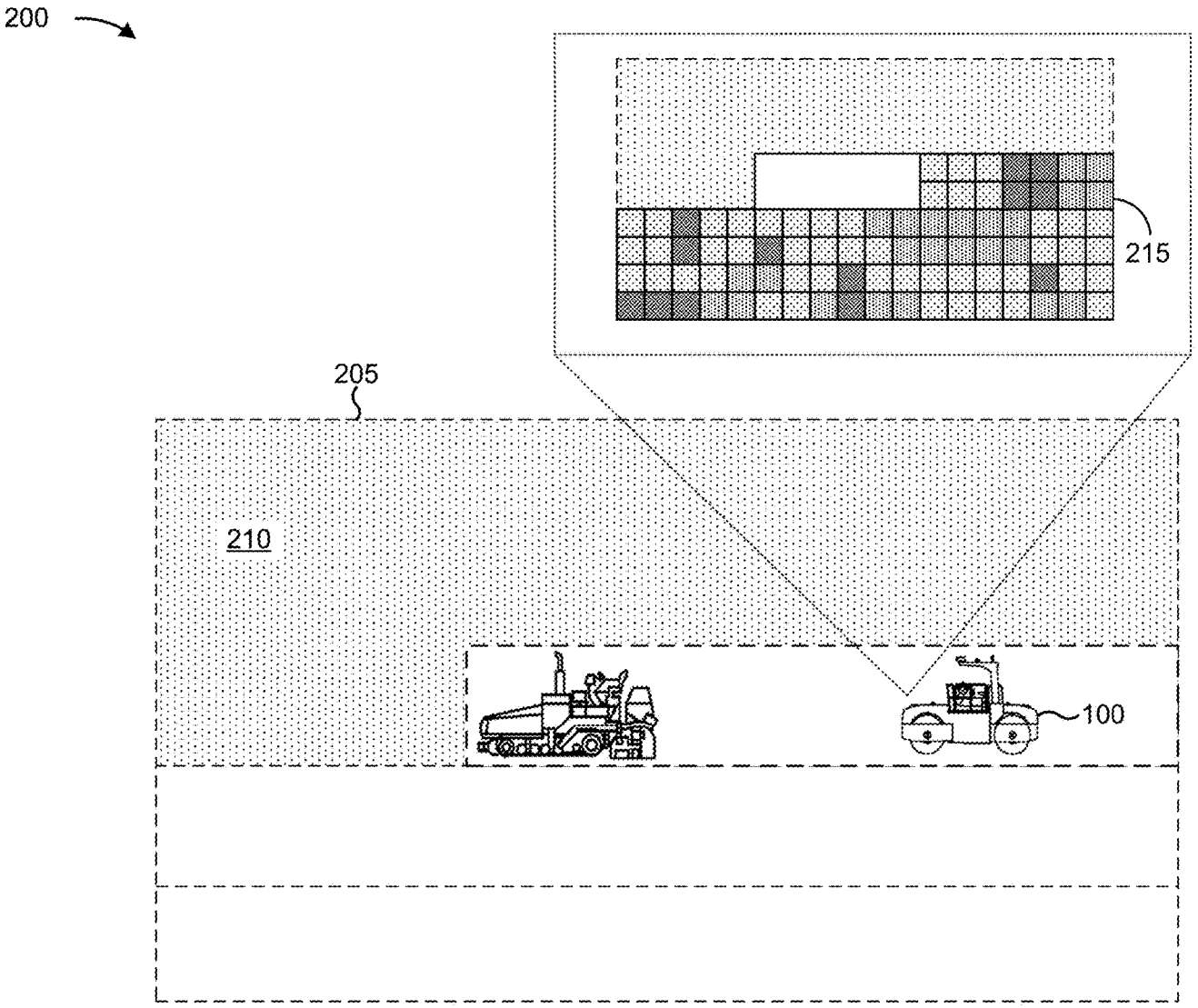
FIG. 2 is a diagram of an example associated with compaction energy monitoring.

FIG. 2 is a diagram of an example 200 associated with compaction energy monitoring. As shown, a plurality of machines may perform work at a worksite 205 to condition a ground surface 210. The plurality of machines may include the machine 100 and one or more additional work machines, such as one or more paving machines and/or one or more compactor machines. For example, a paving machine may perform a paving operation to distribute a paving material mat (e.g., an asphalt mat) over the ground surface 210, and the machine 100 may follow the paving machine to compact the paving material. In some implementations, the machine 100 may operate at the worksite 205 in an autonomous driving mode, in which propulsion, steering, and braking are controlled autonomously by the machine 100. Alternatively, driving operations of the machine 100, such as propulsion, steering, and braking, may be controlled manually by an operator of the machine 100.

The controller 122 may obtain, using a global positioning system (GPS) of the machine 100, location data indicating a location of the machine 100 on a paving material mat. For example, as the machine 100 travels on the paving material mat (e.g., to perform compacting), the controller 122 may periodically detect a location of the machine 100 (e.g., using the GPS). The location of the machine 100 may be represented by geographic coordinates (e.g., latitude and longitude coordinates).

Additionally, the controller 122 may obtain compaction data indicating a vibration amplitude and/or a vibration frequency used for a compaction drum 102 or 104 at the location of the machine 100 on the paving material mat. For example, at each location of the machine 100, the controller 122 may obtain compaction data associated with the location. Accordingly, as the machine 100 travels on the paving material mat (e.g., to perform compacting), the controller 122 may generate information indicating a plurality of locations of the machine 100 and respective compaction data for each location. In some implementations, the controller 122 may obtain first compaction data indicating a vibration amplitude and/or a vibration frequency used for a first compaction drum 102 and second compaction data indicating a vibration amplitude and/or a vibration frequency used for a second compaction drum 104. For example, the vibration amplitude and/or the vibration frequency used for the first compaction drum 102 may be different than the vibration amplitude and/or the vibration frequency used for the second compaction drum 104 (e.g., one of the compaction drums 102 or 104 may be using vibration and the other of the compaction drums 102 or 104 may not be using vibration). In some implementations, the compaction data may indicate a tire pressure of one or more pneumatic tires of the machine 100.

In some examples, to obtain the compaction data, the controller 122 may detect the vibration amplitude and/or the vibration frequency used for the compaction drum 102 or 104 using the sensor 124. For example, the sensor 124 may be a vibration sensor, such as a strain gauge, an accelerometer, a gyroscope, an inertial measurement unit, and/or a piezoelectric sensor, among other examples. Because vibrations produced by the compaction drum 102 or 104 are significant in magnitude, the sensor 124 used to detect such vibrations can be relatively simple and inexpensive. The controller 122 may detect the vibration amplitude and/or the vibration frequency using the sensor 124 in cases in which the vibration amplitude and/or the vibration frequency can be dynamically adjusted during a compacting operation. In some other examples, to obtain the compaction data, the controller 122 may identify a vibration setting in use for the compaction drum 102 or 104. For example, the vibration setting may be associated with the vibration amplitude and/or the vibration frequency that is used statically by the compaction drum 102 or 104, for example, by a scaling factor, which could be a constant. The scaling factor also could be a linear variable, or a non-linear variable, with a value depending upon the value of the vibration amplitude and/or the vibration frequency. In some implementations, the controller 122 may detect a tire pressure one or more pneumatic tires of the machine 100 using a sensor (e.g., a pressure sensor).

The controller 122 may determine a compaction energy (e.g., an energy of compactive force) produced by the machine 100 at the location on the paving material mat. For example, the compaction energy may relate to an area (e.g., a square foot, a square yard, or the like) associated with the location. The controller 122 may determine the compaction energy (e.g., using an algorithm) based at least in part on the compaction data obtained for that location. For example, the compaction energy may be based on the compaction data, a weight of the machine 100 (e.g., a local weight of the machine 100 at the compaction drum 102 or 104, or a total weight of the machine 100), and/or an amount of time that is spent by the machine 100 at the location. The controller 122 may determine the amount of time spent by the machine 100 at the location based on a speed of the machine 100 at the location and/or based on timestamps associated with the location data (e.g., a difference between timestamps associated with locations that are immediately before and after the location may indicate the amount of time spent by the machine 100 at the location).

In some implementations, to determine the compaction energy, the controller 122 may determine a first compaction energy produced by the first compaction drum 102 at the location and a second compaction energy produced by the second compaction drum 104 at the location. For example, the controller 122 may determine the first compaction energy based on the first compaction data (indicating a vibration amplitude and/or a vibration frequency used for the first compaction drum 102), a weight of the machine 100 at the first compaction drum 102, and/or an amount of time that is spent by the first compaction drum 102 at the location. Continuing with the example, the controller 122 may determine the second compaction energy based on the second compaction data (indicating a vibration amplitude and/or a vibration frequency used for the second compaction drum 104), a weight of the machine 100 at the second compaction drum 104, and/or an amount of time that is spent by the second compaction drum 104 at the location. In other words, the controller 122 may determine separate compaction energies produced by the first compaction drum 102 and the second compaction drum 104.

Alternatively, to determine the compaction energy, the controller 122 may determine a total (e.g., aggregate) compaction energy produced by the machine 100 based on the compaction data (indicating a vibration amplitude and/or a vibration frequency used for the first compaction drum 102 and used for the second compaction drum 104), a weight of the machine 100, and/or an amount of time that is spent by the machine 100 at the location. In other words, the controller 122 may determine a compaction energy produced by the machine 100 as a whole.

The controller 122 may perform one or more actions based on the compaction energy produced by the machine 100 at the location on the paving material mat. For example, the controller 122 may perform the one or more actions based on compaction energies produced by the machine 100 at a plurality of locations of the paving material mat (e.g., the compaction energies at the plurality of locations including the compaction energy at the location). The action(s) may include generating a compaction map, causing presentation of the compaction map on the display 112 of the machine 100, causing the machine 100 to perform a compacting operation, and/or transmitting a notification indicating that a compacting operation is to be performed, among other examples.

In some examples, the controller 122 may generate a compaction map 215 indicating a degree of compaction at least at the location on the paving material mat. For example, the degree of compaction at the location may be based on the compaction energy determined for the location. In some examples, the degree of compaction at the location may be based on the first compaction energy produced by the first compaction drum 102 and the second compaction energy produced by the second compaction drum 104. For example, the degree of compaction may be an initial degree of compaction attributable to the first compaction energy produced by the first compaction drum 102, and an additional degree of compaction, added to the initial degree of compaction, attributable to the second compaction energy produced by the second compaction drum 104. In some other examples, the degree of compaction at the location may be based on the total compaction energy produced by the machine 100 (e.g., when the first compaction drum 102 and the second compaction drum 104 are used).

In some implementations, the controller 122 may compute a density for the location based on the compaction energy for the location (e.g., using a compaction energy-to-density conversion that is based on actual density measurements observed for a paving material mat following compaction using known compaction energies). Accordingly, the degree of compaction at the location may be indicated by a density for the location. Additionally, or alternatively, the degree of compaction at the location may be indicated by a score (e.g., the controller 122 may convert the compaction energy to a compaction score, such as on a 0-100 scale, or the like). Additionally, or alternatively, the degree of compaction at the location may be indicated by the compaction energy for the location (e.g., a lower compaction energy indicates a lower degree of compaction, and a higher compaction energy indicates a higher degree of compaction).

Generating the compaction map 215 may include creating a new compaction map or updating an existing compaction map. The compaction map 215 generated by the controller 122 may indicate respective degrees of compaction at a plurality of locations of the paving material mat (e.g., which may be, but does not have to be, expressed visually). For example, as the machine 100 travels on the paving material mat, the controller 122 may determine compaction energies at a plurality of locations, and the controller 122 may generate the compaction map 215 based on the compaction energies at the plurality of locations. Thus, the compaction map 215 may indicate degrees of compaction associated with a plurality of locations on the paving material mat.

The controller 122 may cause the presentation of information relating to the compaction map 215 on the display 112 of the machine 100. For example, the information may include a visual map based on the compaction map 215 (as shown in FIG. 2) showing the degrees of compaction across the paving material mat. As an example, the visual map may include a representation of the paving material mat, and a grid overlaid on the representation of the paving material mat, where different fills, shading, color intensity, colors, or the like, of cells of the grid indicate different degrees of compaction for those cells, and where like fills, shading, color intensity, colors, or the like, of cells of the grid indicate the same degree of compaction for those cells. As another example, the visual map may be an augmented reality overlay on the real-world paving material mat. In a similar manner as described above, the augmented reality overlay may include a grid where different fills, shading, color intensity, colors, or the like, of cells of the grid indicate different degrees of compaction.

The controller 122 may determine, based on the compaction map 215 (and/or based on the compaction energies used across the paving material mat), that a particular degree of compaction of an area of the paving material mat is below a target degree of compaction (e.g., a reference degree of compaction based on a standard or based on other areas of the paving material mat with higher degrees of compaction). Moreover, the controller 122 may determine, based on the compaction map 215 (and/or based on the compaction energies used across the paving material mat), an adjustment to one or more settings of the machine 100 to be used for the area of the paving material mat. For example, an amount of the adjustment may be based on an amount by which the particular degree of compaction of the area differs from the target degree of compaction. The one or more settings may include a vibration amplitude used for the compaction drum 102 and/or 104, a vibration frequency used for the compaction drum 102 and/or 104, and/or a travel speed of the machine 100, among other examples.

The controller 122 may cause, in accordance with the compaction map 215 (and/or in accordance with the compaction energies used across the paving material mat), the machine 100 to perform a compacting operation at the area of the paving material mat. For example, the controller 122 may cause the machine 100 to travel to (e.g., return to) the area. The controller 122 may cause the machine 100 to perform the compacting operation at the area based on determining that the particular degree of compaction associated with the area is below the target degree of compaction. To cause the machine 100 to perform the compacting operation at the area of the paving material mat, the controller 122 may generate a control signal for an autonomous control system of the machine 100. For example, the control signal may identify geographic coordinates associated with the area. Furthermore, the controller 122 may cause the machine 100 to use the adjustment to the one or more settings for the compacting operation at the area of the paving material mat. For example, the control signal for the autonomous control system may indicate the adjustment to the one or more settings.

In some implementations, the controller 122 may transmit (e.g., to a display system associated with the display 112, to a user device associated with an operator of the machine 100 and/or a supervisor of the worksite 205, or the like) a notification indicating that the machine 100 is to perform a compacting operation at the area, in response to which, if the machine 100 is not operating autonomously, the machine operator may cause the machine 100 to navigate to and further compact that area. For example, the controller 122 may transmit the notification based on determining that the particular degree of compaction associated with the area is below the target degree of compaction. The notification may also indicate directions to the area, or the like. Furthermore, the notification may indicate the adjustment to the one or more settings for the compacting operation at the area of the paving material mat. In some implementations, the controller 122 may transmit the notification to another compactor machine (e.g., using machine-to-machine communication) to cause the other compactor machine to perform the compacting operation at the area of the paving material mat.

As indicated above, FIG. 2 is provided as an example. Other examples may differ from what is described in connection with FIG. 2.

Figure 3:
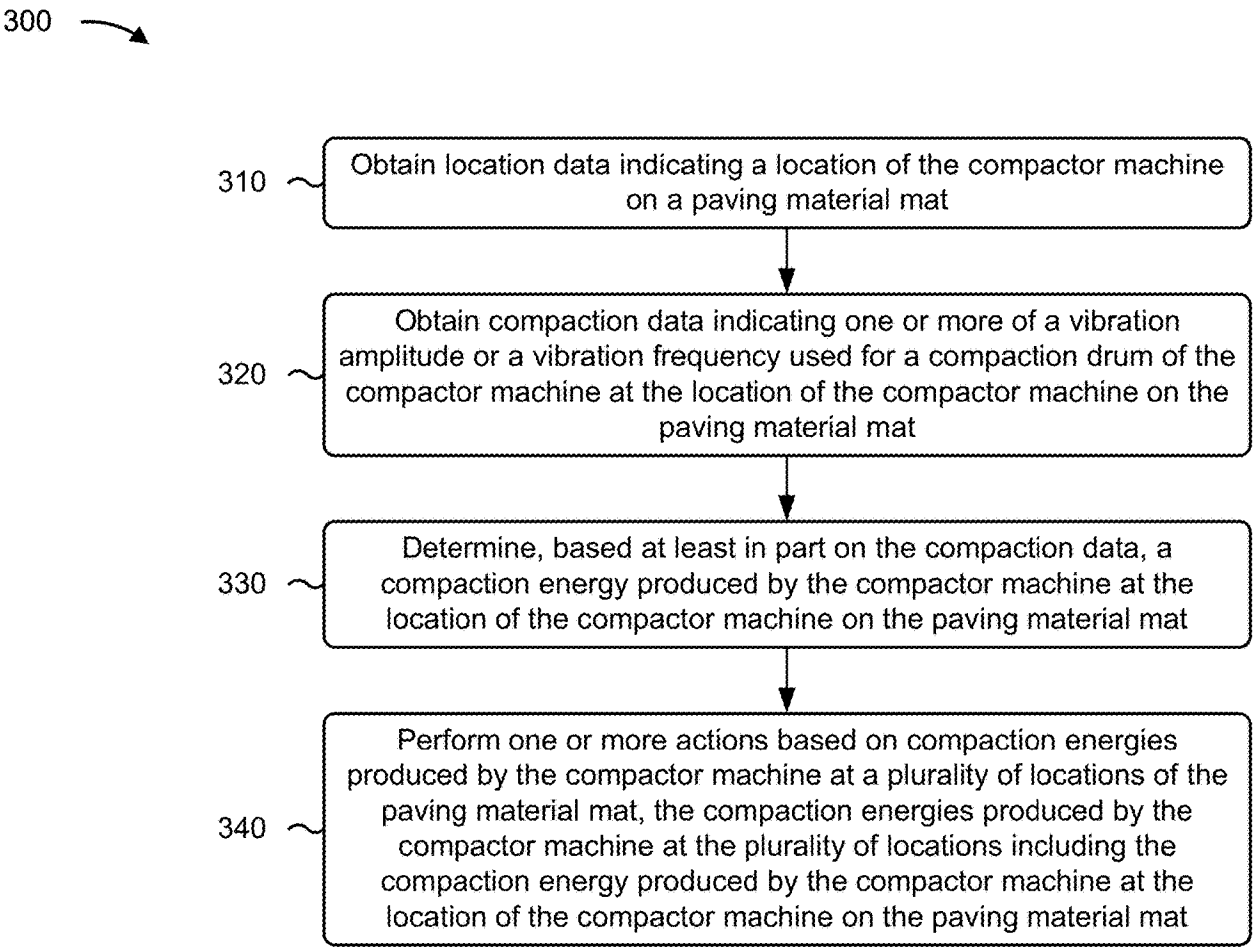
FIG. 3 is a flowchart of an example process associated with monitoring compaction energy into a paving material mat.

FIG. 3 is a flowchart of an example process 300 associated with monitoring compaction energy into a paving material mat. One or more process blocks of FIG. 3 may be performed by a controller (e.g., controller 122). Additionally, or alternatively, one or more process blocks of FIG. 3 may be performed by another device or a group of devices separate from or including the controller, such as another device or component that is internal or external to the machine 100.

As shown in FIG. 3, process 300 may include obtaining location data indicating a location of a compactor machine on a paving material mat (block 310). For example, the controller may obtain the location data, as described above. The location data may be obtained using a GPS of the compactor machine.

As further shown in FIG. 3, process 300 may include obtaining compaction data indicating one or more of a vibration amplitude or a vibration frequency used for a compaction drum of the compactor machine at the location of the compactor machine on the paving material mat (block 320). For example, the controller may obtain the compaction data (e.g., at a plurality of locations of the compactor machine on the paving material mat), as described above. Obtaining the compaction data may include detecting the vibration amplitude and/or the vibration frequency used for the compaction drum using a sensor of the compactor machine. Obtaining the compaction data may include obtaining first compaction data for a first compaction drum of the compactor machine at the location and second compaction data for a second compaction drum of the compactor machine at the location.

As further shown in FIG. 3, process 300 may include determining, based at least in part on the compaction data, a compaction energy produced by the compactor machine at the location of the compactor machine on the paving material mat (block 330). For example, the controller may determine the compaction energy (e.g., compaction energies produced by the compactor machine at the plurality of locations on the paving material mat), as described above. Determining the compaction energy may include determining the compaction energy based on the compaction data, a weight of the compactor machine, and an amount of time that is spent by the compactor machine at the location. In some examples, determining the compaction energy may include determining a first compaction energy produced by the first compaction drum at the location based on the first compaction data and a second compaction energy produced by the second compaction drum at the location based on the second compaction data.

Process 300 may include generating, based on the compaction energy, a compaction map indicating a degree of compaction at least at the location of the compactor machine on the paving material mat. The degree of compaction at the location may be based on the first compaction energy and the second compaction energy. The compaction map may indicate respective degrees of compaction at a plurality of locations of the paving material mat.

As further shown in FIG. 3, process 300 may include performing one or more actions based on compaction energies produced by the compactor machine at a plurality of locations of the paving material mat, the compaction energies produced by the compactor machine at the plurality of locations including the compaction energy produced by the compactor machine at the location of the compactor machine on the paving material mat (block 340). For example, the controller may perform one or more actions, as described above.

Performing the one or more actions may include causing presentation of information relating to the compaction map on a display of the compactor machine. Additionally, or alternatively, performing the one or more actions may include causing the compactor machine to perform a compacting operation at an area of the paving material mat. Additionally, or alternatively, performing the one or more actions may include transmitting a notification indicating that the compactor machine is to perform a compacting operation at an area of the paving material mat. Additionally, or alternatively, performing the one or more actions may include causing, in accordance with the compaction map, an adjustment to one or more of the vibration amplitude used for the compaction drum, the vibration frequency used for the compaction drum, or a travel speed of the compactor machine.

Causing the compactor machine to perform the compacting operation may be in accordance with the compaction map (e.g., based on the compaction energies produced by the compactor machine at the plurality of locations on the paving material mat). Causing the compactor machine to perform the compacting operation may include determining, based on the compaction map, that a particular degree of compaction associated with the area of the paving material mat is below a target degree of compaction, and causing the compactor machine to perform the compacting operation at the area of the paving material mat based on determining that the particular degree of compaction associated with the area is below the target degree of compaction. Causing the compactor machine to perform the compacting operation may include generating a control signal for an autonomous control system of the compactor machine, the control signal identifying geographic coordinates associated with the area.

Although FIG. 3 shows example blocks of process 300, in some implementations, process 300 may include additional blocks, fewer blocks, different blocks, or differently arranged blocks than those depicted in FIG. 3. Additionally, or alternatively, two or more of the blocks of process 300 may be performed in parallel.

INDUSTRIAL APPLICABILITY

The controller described herein may be used with any machine configured to perform compacting of a ground surface. For example, the controller may be used with a compactor machine that includes one or more compaction drums, such as vibratory compaction drums. Various parameters of a compactor machine, such as travel speed, drum vibration amplitude, and/or drum vibration frequency, may be controlled during compaction to affect the density of compacted paving material. Because these parameters may not be constant over the course of a compacting operation, density variations of the compacted paving material may develop. In general, detecting the density of paving material being compacted is technically difficult, thereby making it difficult to ensure that uniform density of the paving material is produced over a compacted area. As a result, the compacted area may need to be repaired or re-paved, thereby using excessive machine hours, increasing machine wear, and/or increasing fuel consumption.

The controller described herein is useful for monitoring a compaction of a paving material mat. In particular, the controller may determine compaction energies produced by a compactor machine based on a vibration amplitude of a compaction drum, a vibration frequency of the compaction drum, a weight of the compactor machine, and/or an amount of time that the machine spends compacting an area of the paving material mat. Based on the compaction energies, the controller may generate a compaction map indicating degrees of compaction at locations across the paving material mat. The compaction map enables the controller to identify areas of the paving material mat that are in need of additional compaction. The controller may cause the compactor machine to perform a compacting operation at those areas of the paving material mat, and/or the controller may transmit a notification for an operator of the compactor machine indicating the areas of the paving material mat in need of additional compacting. In this way, the controller improves the uniformity of the density of the paving material mat, and compacting of the paving material mat may be completed in reduced time and with reduced repair and/or repetition. Accordingly, the controller conserves machine hours, reduces machine wear, and/or reduces fuel consumption.

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of").

What is claimed is:

1. A compactor machine, comprising:

a compaction drum comprising a vibratory component configured to vibrate the compaction drum; and a controller, comprising one or more processors, configured to:

detect, using a vibration sensor, compaction data indicating a vibration amplitude and a vibration frequency used for the compaction drum at a location of the compactor machine on a paving material mat;

determine, based at least in part on the compaction data, a local weight of the compactor machine at the compaction drum, and an amount of time spent by the compactor machine at the location, a compaction energy produced by the compactor machine at the location of the compactor machine on the paving material mat;

generate, based on the compaction energy, a compaction map indicating degrees of compaction at least at the location of the compactor machine on the paving material mat;

cause, in accordance with the compaction map, an adjustment to at least one of the vibration amplitude, the vibration frequency, or a travel speed of the compactor machine, wherein an amount of the adjustment is based on an amount by which a degree of compaction at the location differs from a target degree of compaction; and cause, in accordance with the compaction map, the compactor machine to return to the location to perform a compacting operation using the adjustment.

2. The compactor machine of claim 1, wherein the controller is further configured to:

cause the compactor machine to perform a compacting operation at an area of the paving material mat in accordance with the compaction map.

3. The compactor machine of claim 1, wherein the controller, to cause the adjustment, is configured to: cause, in accordance with the compaction map, the adjustment to one or more of the vibration amplitude used for the compaction drum or the vibration frequency used for the compaction drum.

4. The compactor machine of claim 1, wherein the compaction drum is a first compaction drum and the compactor machine further comprises a second compaction drum, and wherein the controller, to obtain the compaction data, is configured to:

obtain first compaction data for the first compaction drum at the location and second compaction data for the second compaction drum at the location.

5. The compactor machine of claim 4, wherein the local weight is a first local weight, and wherein the controller, to determine the compaction energy produced by the compactor machine, is configured to:

determine a first compaction energy produced by the first compaction drum at the location based on the first compaction data, the first local weight of the compactor machine at the first compaction drum, and the amount of time spent by the compactor machine at the location, and a second compaction energy produced by the second compaction drum at the location based on the second compaction data, a second local weight of the compactor machine at the second compaction drum, and the amount of time spent by the compactor machine at the location, wherein the degree of compaction at the location is based on the first compaction energy and the second compaction energy.

6. The compactor machine of claim 1, wherein the controller is further configured to: obtain, using a global positioning system of the compactor machine, location data indicating the location of the compactor machine on the paving material mat.

7. The compactor machine of claim 1, wherein the controller is further configured to: cause presentation of information relating to the compaction map on a display of the compactor machine.

8. The compactor machine of claim 1, wherein the compaction map indicates respective degrees of compaction at a plurality of locations of the paving material mat.

9. A controller of a compactor machine, comprising:

one or more memories; and one or more processors, coupled to the one or more memories, configured to:

obtain location data indicating a location of the compactor machine on a paving material mat;

obtain compaction data indicating one or more of a vibration amplitude or a vibration frequency used for a compaction drum of the compactor machine at the location of the compactor machine on the paving material mat;

determine, based at least in part on the compaction data, a local weight of the compactor machine at the compaction drum, and an amount of time spent by the compactor machine at the location, a compaction energy produced by the compactor machine at the location of the compactor machine on the paving material mat, wherein the compaction energy indicates a degree of compaction at the location;

cause, in accordance with the degree of compaction, an adjustment to at least one of the vibration amplitude, the vibration frequency, or a travel speed of the compactor machine, wherein an amount of the adjustment is based on an amount by which the degree of compaction differs from a target degree of compaction; and cause the compactor machine to return to the location to perform a compacting operation using the adjustment.

10. The controller of claim 9, wherein the one or more processors are further configured to:

generate, based on the compaction energy, a compaction map indicating the degree of compaction at least at the location of the compactor machine on the paving material mat.

11. The controller of claim 10, wherein the one or more processors are further configured to:

cause presentation of information relating to the compaction map on a display of the compactor machine.

12. The controller of claim 10, wherein the one or more processors are further configured to:

cause the compactor machine to perform a compacting operation at an area of the paving material mat in accordance with the compaction map.

13. The controller of claim 9, wherein the one or more processors are further configured to:

transmit a notification indicating that the compactor machine is to perform a compacting operation at an area of the paving material mat.

14. A method, comprising:

obtaining, by a controller of a compactor machine, compaction data indicating one or more of a vibration amplitude or a vibration frequency used for a compaction drum of the compactor machine at a plurality of locations of the compactor machine on a paving material mat;

determining, by the controller and based at least in part on the compaction data, a local weight of the compactor machine at the compaction drum, and amounts of time spent by the compactor machine at the plurality of locations, compaction energies produced by the compactor machine at the plurality of locations on the paving material mat, wherein the compaction energies indicate respective degrees of compaction at the plurality of locations;

causing, by the controller and in accordance with a degree of compaction at a location, an adjustment to at least one of the vibration amplitude or the vibration frequency, wherein an amount of the adjustment is based on an amount by which the degree of compaction differs from a target degree of compaction; and causing, by the controller, the compactor machine to return to the location to perform a compacting operation using the adjustment.

15. The method of claim 14, wherein a compaction energy, at the location, is determined based on the vibration amplitude used for the compaction drum at the location, the vibration frequency used for the compaction drum at the location, the local weight of the compactor machine at the compaction drum, and an amount of time that is spent by the compactor machine at the location.

16. The method of claim 14, wherein obtaining the compaction data comprises:

detecting the one or more of the vibration amplitude or the vibration frequency used for the compaction drum using a sensor of the compactor machine.

17. The method of claim 14, further comprising:

generating, based on the compaction energies, a compaction map indicating the respective degrees of compaction at the plurality of locations on the paving material mat.

18. The method of claim 14, wherein the adjustment is further to a travel speed of the compactor machine.

19. The method of claim 14, wherein the degree of compaction at the location is a density of the paving material mat at the location.

* * * * *